US006547157B2

(12) United States Patent
Jervas

(10) Patent No.: US 6,547,157 B2
(45) Date of Patent: Apr. 15, 2003

(54) METHOD AND DEVICE FOR MAKING SNOW

(75) Inventor: Troy Jervas, Pittsfield, MA (US)

(73) Assignee: Topgun Snow Making Systems, Inc., Emeryville, CA (US)

( * ) Notice: Subject to any disclaimer, the term of this patent is extended or adjusted under 35 U.S.C. 154(b) by 7 days.

(21) Appl. No.: 09/754,989

(22) Filed: Jan. 5, 2001

(65) Prior Publication Data

US 2001/0030242 A1 Oct. 18, 2001

Related U.S. Application Data

(60) Provisional application No. 60/174,753, filed on Jan. 6, 2000.

(51) Int. Cl.[7] ..... F25C 3/04; A62C 2/08; A62C 37/08; B05B 1/14

(52) U.S. Cl. ..... 239/14.2; 239/2.2; 239/548; 239/551

(58) Field of Search ..... 239/14.2, 2.2, 239/67, 69, 413, 417.5, 418, 433, 549, 562, 426, 551, 548; 138/114

(56) References Cited

U.S. PATENT DOCUMENTS

| | | | | | |
|---|---|---|---|---|---|
| 3,822,825 | A | * | 7/1974 | Dupre | 239/14 |
| 3,952,949 | A | | 4/1976 | Dupre | 239/2 S |
| 4,682,729 | A | * | 7/1987 | Doman et al. | 239/2.2 |
| 5,004,151 | A | | 4/1991 | Dupre | 239/2.2 |
| 5,400,965 | A | * | 3/1995 | Ratnik et al. | 239/2.2 |
| 5,823,427 | A | | 10/1998 | Dupre et al. | 239/14.2 |
| 5,890,654 | A | | 4/1999 | Dupre | 239/14.2 |
| 5,979,785 | A | | 11/1999 | McKinney | 239/2.2 |
| 6,119,956 | A | | 9/2000 | McKinney | 239/14.2 |
| 6,161,769 | A | * | 12/2000 | Kircher et al. | 239/2.2 |

* cited by examiner

*Primary Examiner*—Michael Mar
*Assistant Examiner*—Davis Hwu
(74) *Attorney, Agent, or Firm*—Heslin Rothenberg Farley & Mesiti P.C.; Victor A. Cardona, Esq.

(57) ABSTRACT

The present invention provides a method for making snow. The method includes discharging a supply of pressurized water in ambient air, discharging a supply of pressurized air in ambient air, and controlling the discharge of the supply of pressurized water and/or the discharge of the supply of pressurized air to regulate a ratio of water to air, to more efficiently make snow over a range of ambient temperatures.

2 Claims, 16 Drawing Sheets

METHOD AND DEVICE FOR MAKING SNOW

CROSS REFERENCE TO RELATED APPLICATION

This application claims benefit to U.S. Provisional application Ser. No. 60/174,753, filed Jan. 6, 2000.

TECHNICAL FIELD

The present invention generally relates to artificial snow making, and more particularly, to methods and devices for making snow.

BACKGROUND OF THE INVENTION

In general, artificial snow-making involves atomizing a spray of water with a jet of air to create a plume of very fine water droplets which nucleate and form snow as the plume drops to earth under freezing temperature conditions. Water and air may be brought separately up a tower in inner and outer, concentric, spaced apart conduits. The air may flow through the inner conduit passageway and the water through the annular passageway formed between the conduits. As a result, the water stream functions to insulate the air stream.

The water stream is supplied under pressure to a point of discharge above ground level and adjacent to a top end of a tower where it is discharged through a nozzle into the ambient freezing atmosphere in the form of the spray. The spray is preferably a high velocity spray of discrete water particles. Air is also supplied under pressure to a second point of discharge at the top of the tower where it is discharged through an orifice to form a jet of air which is directed into the water spray thereby forming a plume of atomized or nucleated water. This atomized water forms seed crystals in a freezing atmosphere, and through the dwell time of the long fall from the top of the tower to the ground, forms snow.

One drawback to this type of system is that snow can only be made at specific ambient temperature conditions for a given pressurized water supply and a given pressurized air supply. When the ambient temperature changes from the specific ambient temperature the system operates with decreased efficiency of does not operate at all to produce snow.

Therefore, a need exists for snow making methods and devices to efficiently make snow over a range of ambient temperature conditions.

SUMMARY OF THE INVENTION

The present invention provides, in a first aspect, a method for making snow over a range of ambient temperatures in which the method includes discharging a supply of pressurized water in ambient air, discharging a supply of pressurized air into the discharged supply of pressurized water, and controlling the discharge of the supply of the pressurized water and/or the supply of the pressurized air to control a ratio of water to air.

The present invention provides, in a second aspect, a method for making snow. The method includes providing a discharge unit having a plurality of fluid discharge nozzles, and controlling discharge of a supply of pressurized water and a supply of pressurized air from the plurality of fluid discharge nozzles.

The present invention provides, in a third aspect, a device for making snow. The device includes a discharge unit having a plurality of discharge nozzles and a control mechanism for controlling a supply of pressurized water and a supply of pressurized air to the plurality of discharge nozzles.

BRIEF DESCRIPTION OF THE DRAWINGS

The subject matter which is regarded as the invention is particularly pointed out and distinctly claimed in the claims at the conclusion of the specification. The foregoing and other features, and advantages of the invention will be readily understood from the following detailed description of various embodiments taken in conjunction with the accompanying drawings in which:

DETAILED DESCRIPTION

In accordance with one embodiment of the present invention, a method for making snow is provided. The method includes discharging a supply of pressurized water in ambient air, discharging a supply of pressurized air into the discharged supply of pressurized water, and controlling the discharge of the supply of the pressurized water and/or the discharge of the supply of the pressurized air, based on ambient temperature.

For example, it is desirable to produce a maximum amount of snow for a given ambient air temperature. In order to maximize efficiency of a snow making system, it is preferable to have an adequate water to air ratio for a given ambient air temperature. When ambient air temperatures are above approximately 26 degrees Fahrenheit it may be necessary to provide a relatively large quantity of air to a relatively small quantity of water. However, when ambient air temperatures are below approximately 26 degrees Fahrenheit it is desirable to provide a relatively large quantity of water to a relatively small quantity of air. An adequate air to water ratio allows qualities of snow to be produced at varying ambient air temperatures. By maximizing the amount of snow which can be produced, the overall efficiency of the system is increased while the operating costs of the system are lowered.

Figure 1:
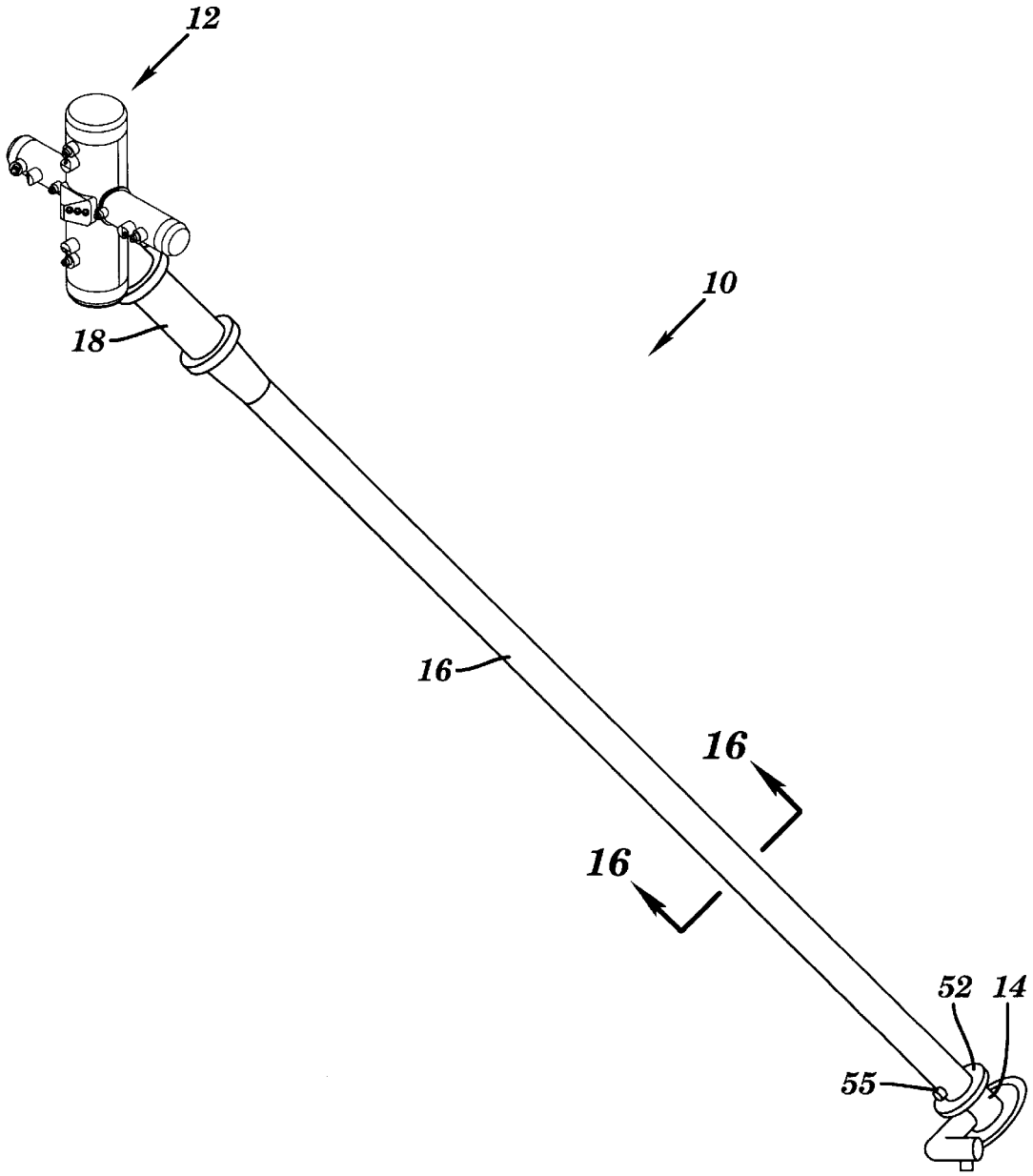
FIG. 1 is a perspective view of a first embodiment of a snow making device according to the present invention.

One example of a snow making device 10 incorporating and using the capabilities of the present invention is described with reference to FIG. 1. Snow making device 10 generally includes a discharge unit 12 connected to a fluid flow control mechanism 18 connected to a conduit 16 and to a control unit 14. Snow making device 10 may be secured to a support structure (not shown) in such a manner as to allow an operator to rotate and/or pivot the device to control the direction of fluid discharge. Snow making device 10 may be positioned along a ski slope adjacent to a ski trail. The components of snow making device 10 may be constructed out of stainless-steel, aluminum alloy or any other suitable material as may be known by those skilled in the art.

Figure 2:
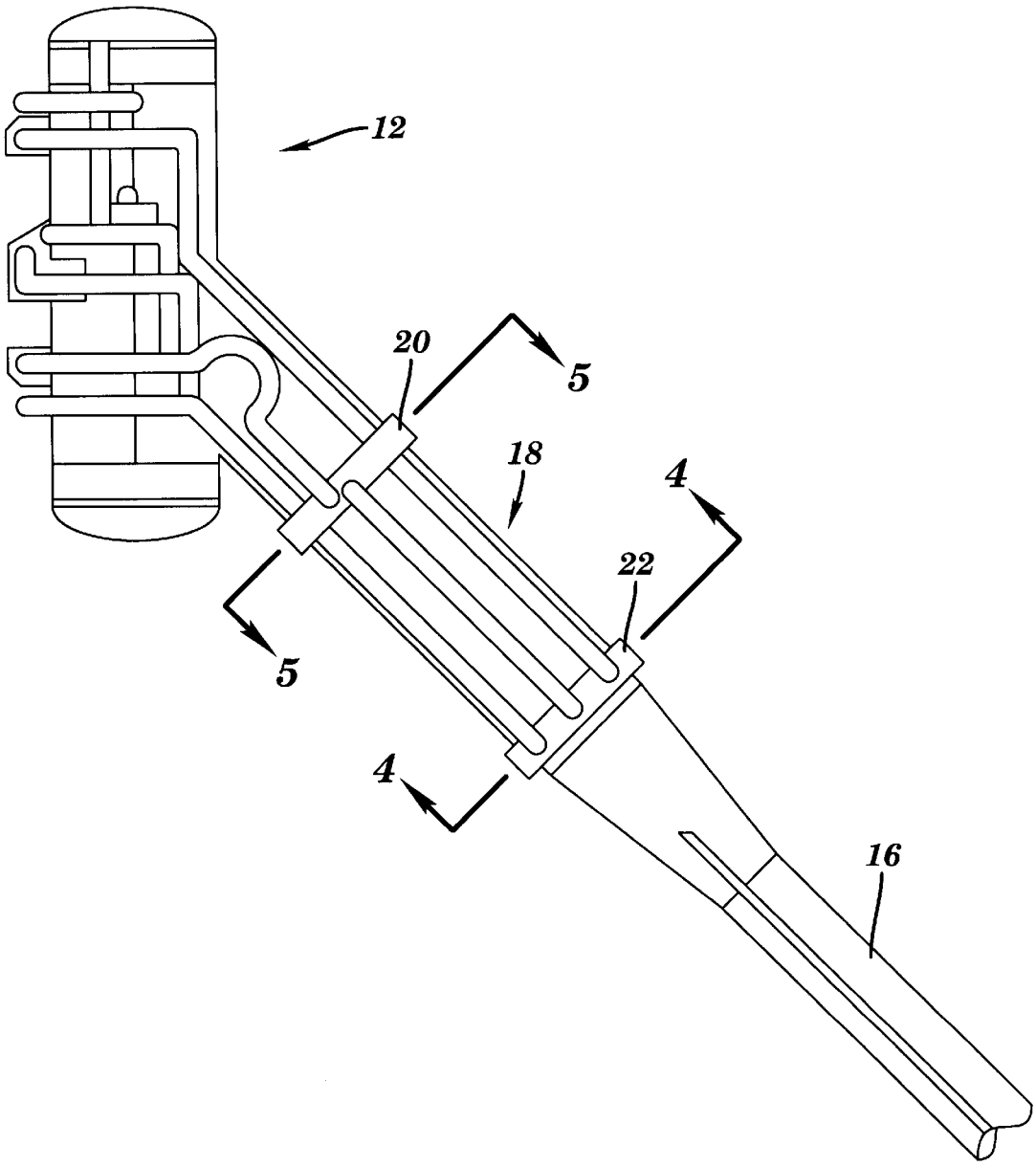
FIG. 2 is an enlarged perspective view of the discharge unit and the fluid flow control mechanism of the snow making device shown in FIG. 1.

As best shown in FIG. 2, discharge unit 12 is mounted on fluid flow control mechanism 18 at flanged connection 20. Fluid flow control mechanism 18 is mounted on the upper end of fluid conduit 16 by a flanged connection 22.

Figure 3:
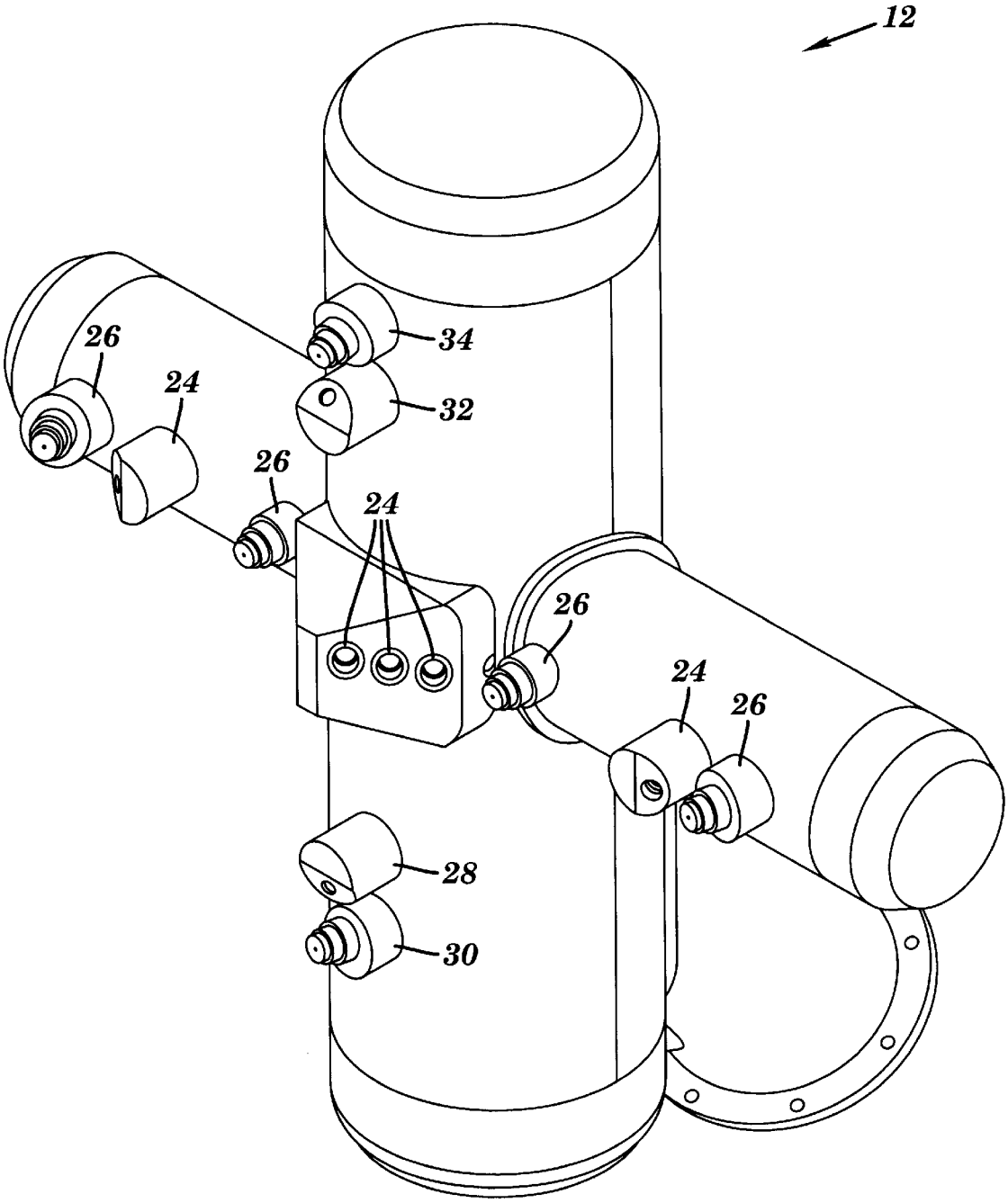
FIG. 3 is an enlarged perspective view of the discharge unit of the snow making device of FIG. 1.

With reference to FIG. 3, discharge unit 12 comprises a plurality of air discharge nozzles 24, and a plurality of water discharge nozzles 26. In this illustrated embodiment discharge unit 12 includes six water discharge nozzles 26, 30 and 34, and ten air discharge nozzles 24, 28, and 32 (only 7 of which are shown) however the placement and/or number of air and water discharge nozzles may be increased or decreased based upon design specifications. Also the shape of discharge unit 12 may be varied from the illustrated design, for example a single elongated tube may comprise a plurality of air and water discharge nozzles, or other shapes and/or designs may be used as is known in the art.

Air discharge nozzles 24 and water discharge nozzles 26 are referred to as the primary air and water discharge nozzles. Also mounted on discharge unit 12 are a first supplemental air nozzle 28, a first supplemental water nozzle 30, a second supplemental air nozzle 32, and a second supplemental water nozzle 34. Supply of air and water to each of the air and/or water nozzles may be individually controlled and regulated by an operator using control unit 14 (FIG. 1) to manipulate the inlets and outlets of fluid flow control mechanism 18 (FIG. 1).

Figure 16:
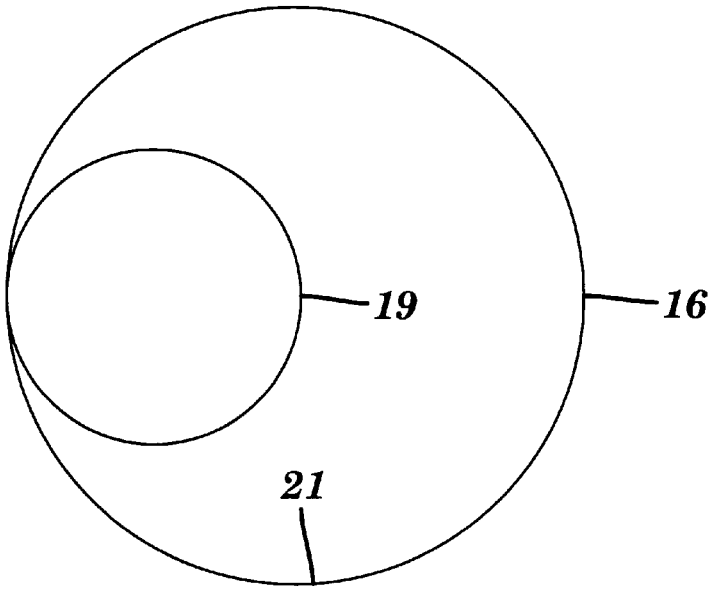
FIG. 16 is an enlarged cross-sectional view taken along line 16—16 of FIG. 1.

Referring again to FIGS. 1 and 2, air and water are supplied to fluid flow control mechanism 18 by fluid conduit 16. As best shown in FIG. 16, fluid conduit 16 desirably has an inner fluid conduit 19 which supplies air, and an outer fluid conduit 21 which supplies water. Through such an arrangement an outer conduit 21 acts as an insulator of inner conduit 19. Also, inner fluid conduit 19 and outer fluid conduit 21 may be offset to one side of fluid conduit 16 to provide space for other components. Alternatively, a conduit system using a pair of separated conduits supplying air and water may be used, or any other system, as may be known by those skilled in the art.

Figure 4:
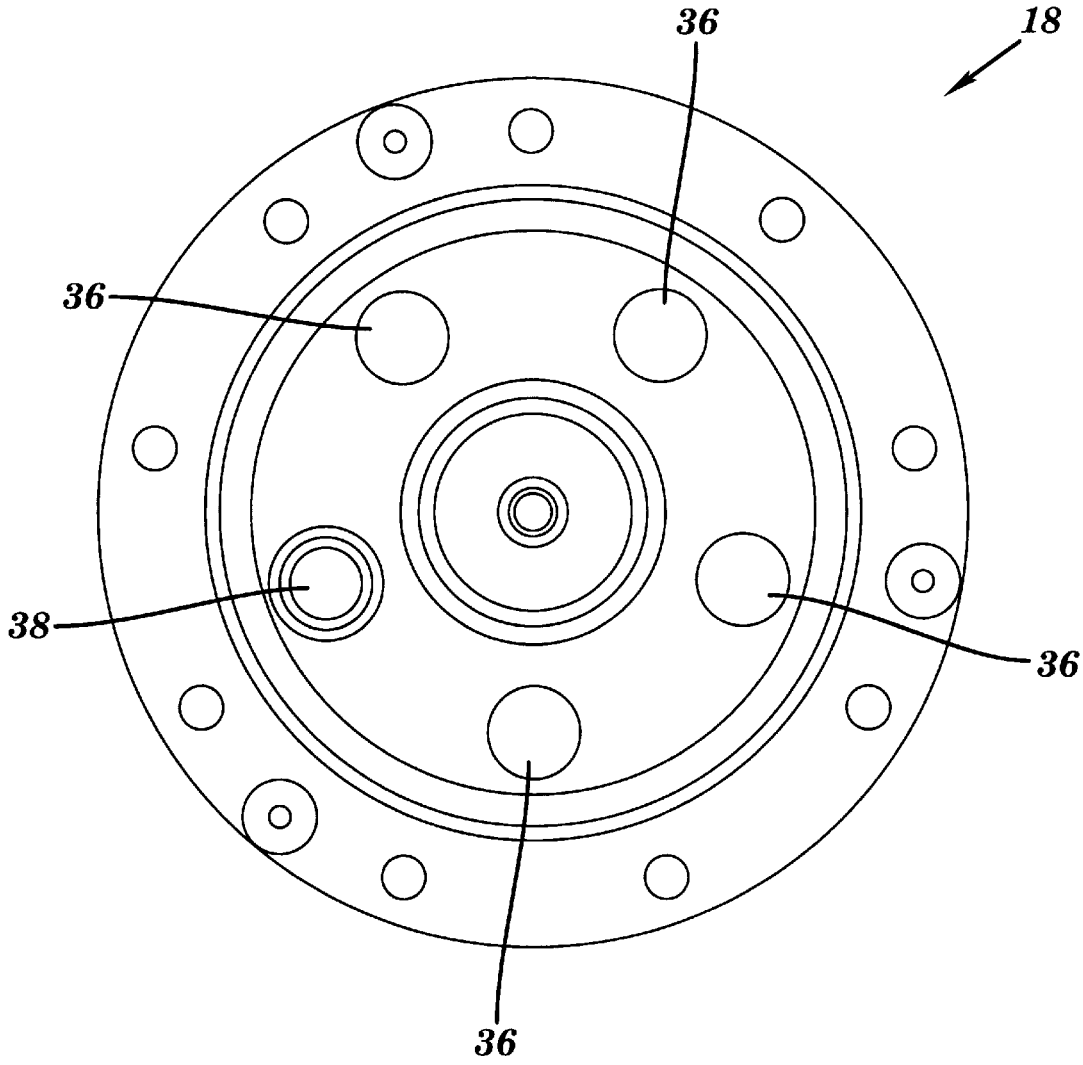
FIG. 4 is an enlarged cross-sectional view taken along line 4—4 of FIG. 2.
Figure 5:
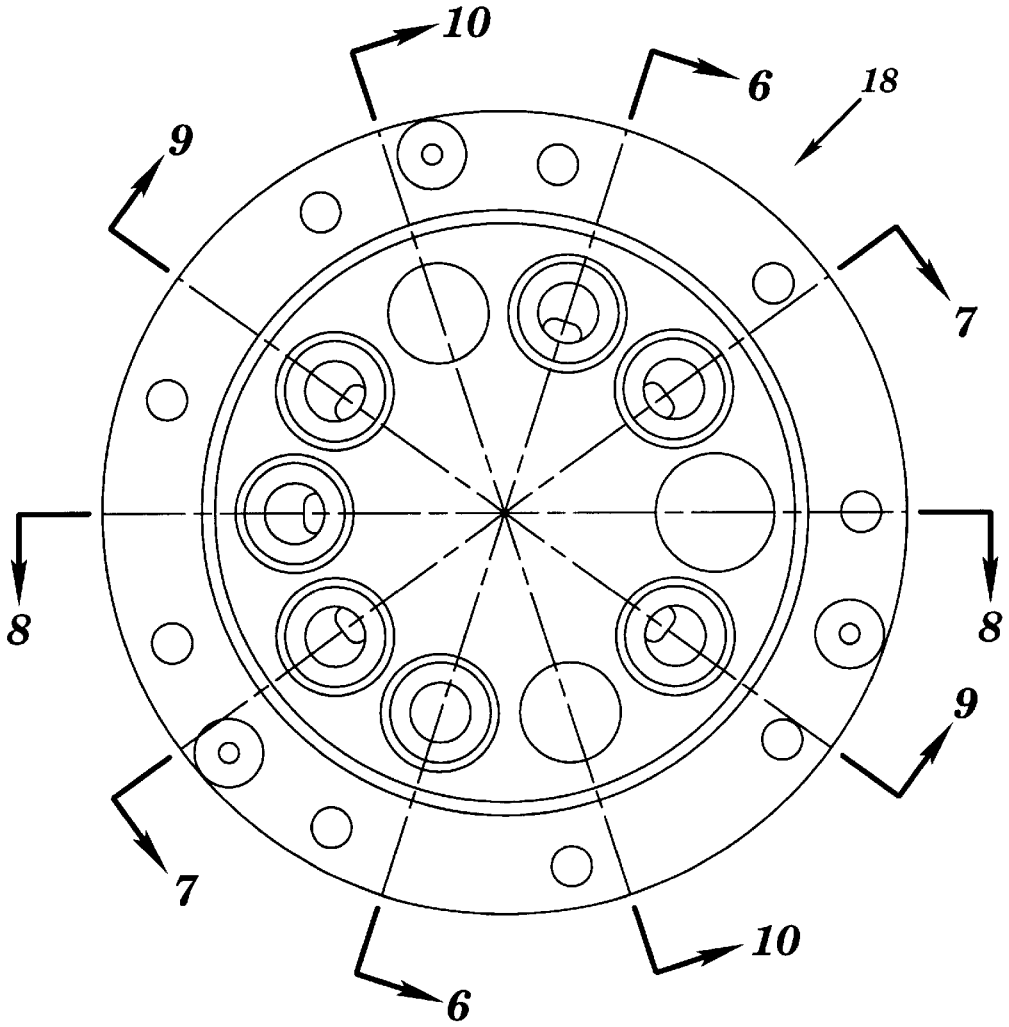
FIG. 5 is an enlarged cross-sectional view taken along line 5—5 of FIG. 2.

Now referring to FIG. 4, fluid flow control mechanism 18 has a plurality of fluid inlet holes 36 and an air inlet 38, located on the lower end. Air inlet 38 is in fluid flow communication with inner air conduit 19 (FIG. 16), which supplies pressurized air to discharge unit 12. Similarly, fluid inlet holes 36 are in fluid flow communication with outer fluid conduit 21 (FIG. 16), which supplies a fluid, such as water, to discharge unit 12. As illustrated in FIG. 5, a plurality of air and fluid outlets are depicted which supply air and fluid to discharge unit 12. The flow of air and fluid to discharge unit 12 is controlled and regulated by fluid flow control mechanism 18.

The inner valve system of fluid flow control mechanism 18 is illustrated in FIGS. 6–10. A rod 40 is manipulated by use of control unit 14 (FIG. 1), e.g. by turning the handle. Manipulation of rod 40 causes a series of valves 42 to open and close, causing fluid to enter flow chambers 44 which are in fluid flow communication with a series of air and fluid conduits 46 which supply air and/or fluid to a respective air and/or fluid discharge nozzle(s). By opening and closing valves 42 different fluid flow configurations are provided for use in various ambient air temperatures.

Figure 11:
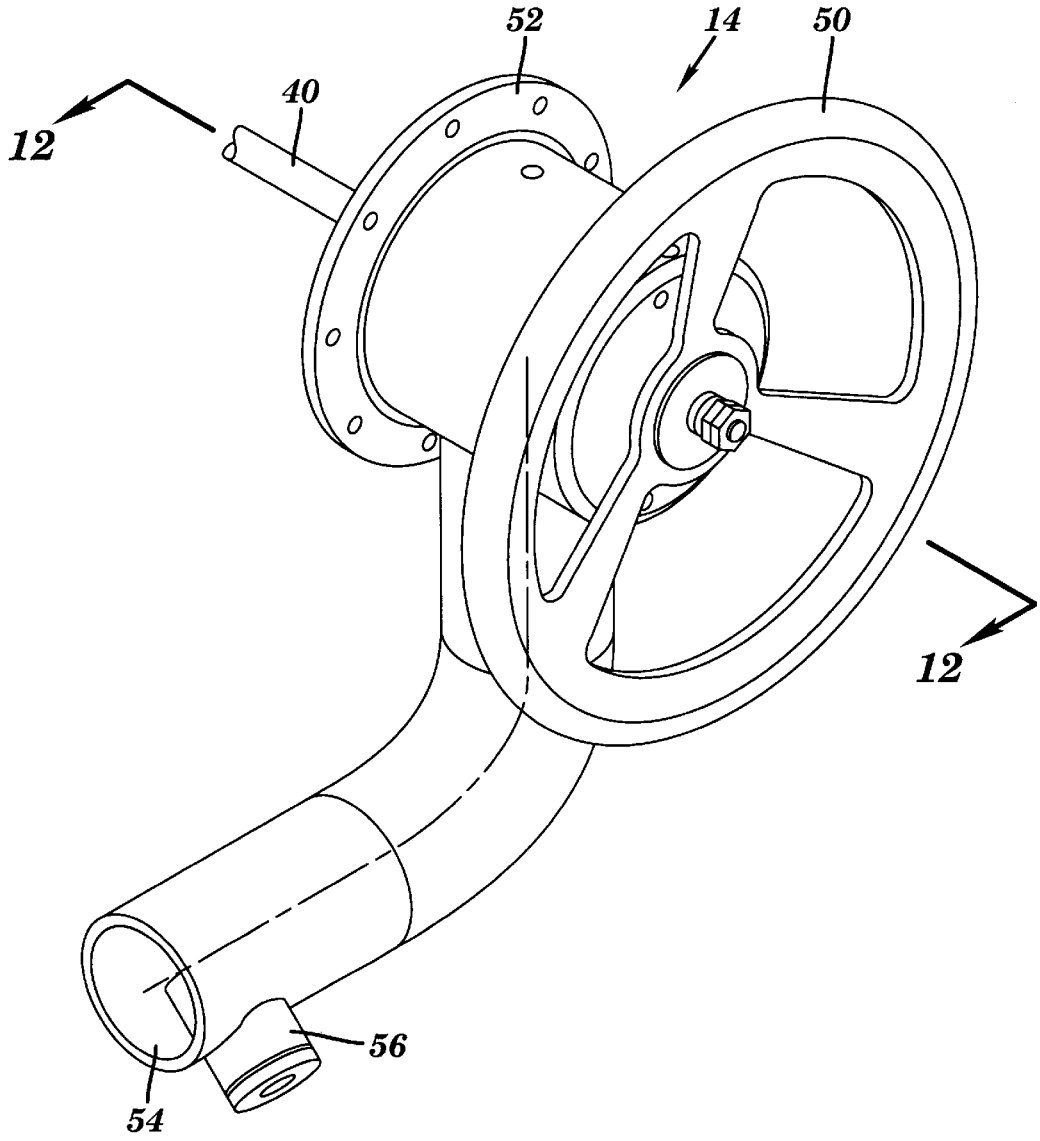
FIG. 11 is a perspective view of a control unit of the snow making of FIG. 1.
Figure 12:
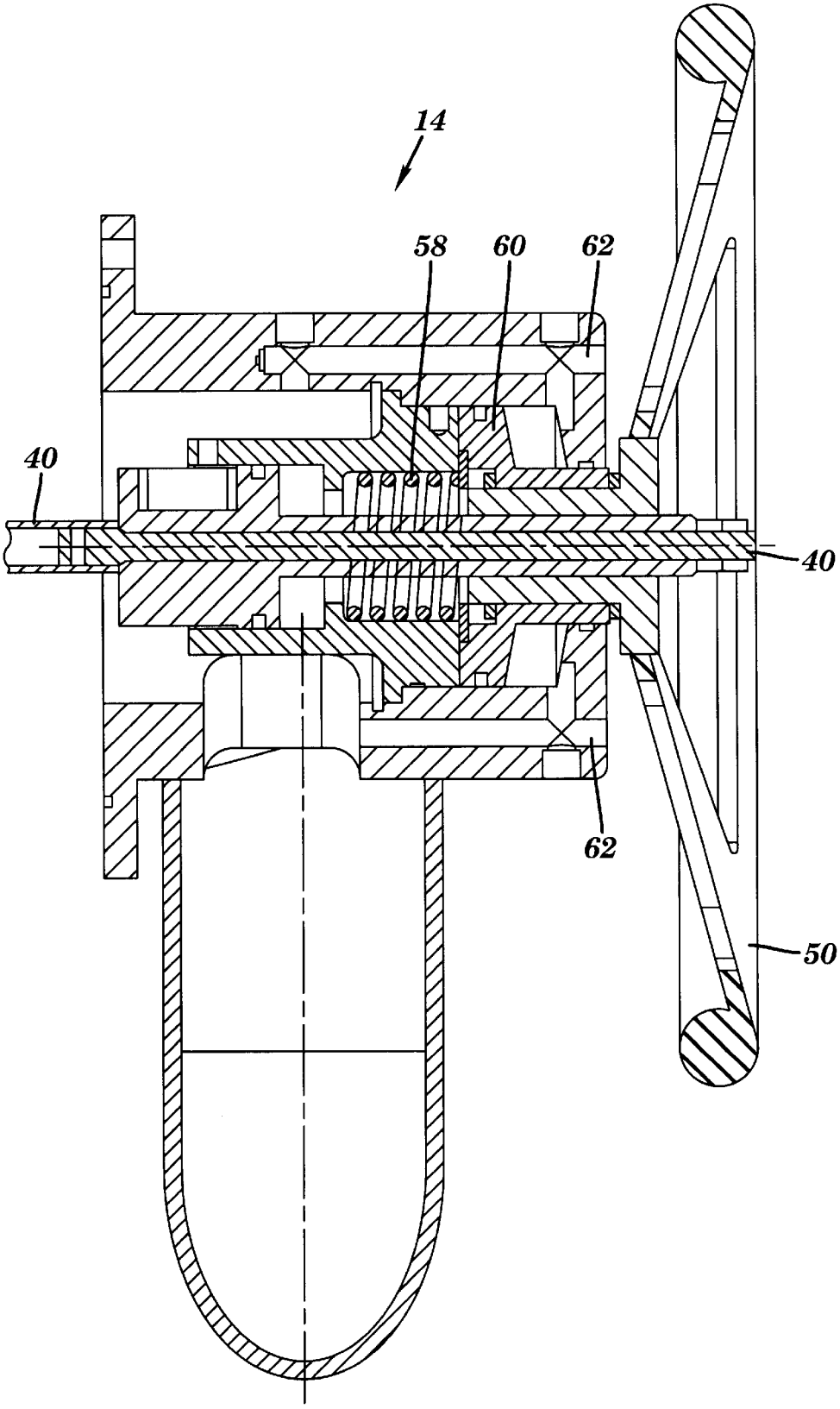
FIG. 12 is a cross-sectional view taken along line 12—12 of FIG. 11.

Referring to FIGS. 11 and 12, rod 40 is manipulated by movement of a handle 50 of control unit 14. Handle 50 may be pulled out to lock in different positions by an operator, with each position opening and/or closing successive valves which corresponds to different fluid flow configurations. Alternatively, handle 50 may be rotated to drive a worm gear (not shown) which in turn moves a rod and thereby opens and closes the valves. Control unit 14 is mounted on the lower end of fluid conduit 16 (FIG. 1) at flanged connection 52. A fluid, such as water, is supplied to the system at fluid inlet 54. Similarly, air may be supplied to the system at air inlet 55 (FIG. 1).

As would be understood by one skilled in the art, rod 40 and/or handle 50 of control unit 14 might be controlled by an automatic or automated controlling assembly (not shown) coupled to a controller (not shown), for example, a microprocessor. Such a controller might also be coupled to a temperature sensor (not shown) which might allow the controller to automatically control rod 40 and/or handle 50 of control unit 14 based on the ambient temperature. Also, handle 50 might be marked to indicate to a user different positions of handle 50 corresponding to different ambient temperature conditions, thus facilitating manual manipulation to these positions based on ambient temperature conditions.

With reference to FIG. 12, control unit 14 is configured with a check valve 56 (FIG. 11) that enables fluid to drain from the system. When the fluid is no longer supplied to the system, the resulting pressure drop opens check valve 56 and fluid is allowed to drain from the system. Check valve 56 is preferably a spring and ball check valve, however any other suitable check valve as may be known in the art may be used. Also, when the system pressure drops, spring 58 moves assembly 60, which retracts rod 40 and opens all of the valves to a position which allows drainage of discharge unit 12 (FIG. 1) and fluid flow control mechanism 18 (FIG. 1) through fluid outlets 62. This safety feature provides for complete, automatic drainage of the device when it is not in use and thereby reduces a risk of a fluid, for example water, freezing inside the device and causing damage thereto.

As would be evident to those skilled in the art from the above description, discharge unit 12 may be provided in various locations, for example, on a snow making tower or on a chair lift support. Also control mechanism 18 and portions thereof may be located at a distance from discharge unit 12, for example, at a bottom of a snow making tower or pole, or a plurality of control mechanisms 18 or portions thereof might be provided in a central location.

Figure 13:
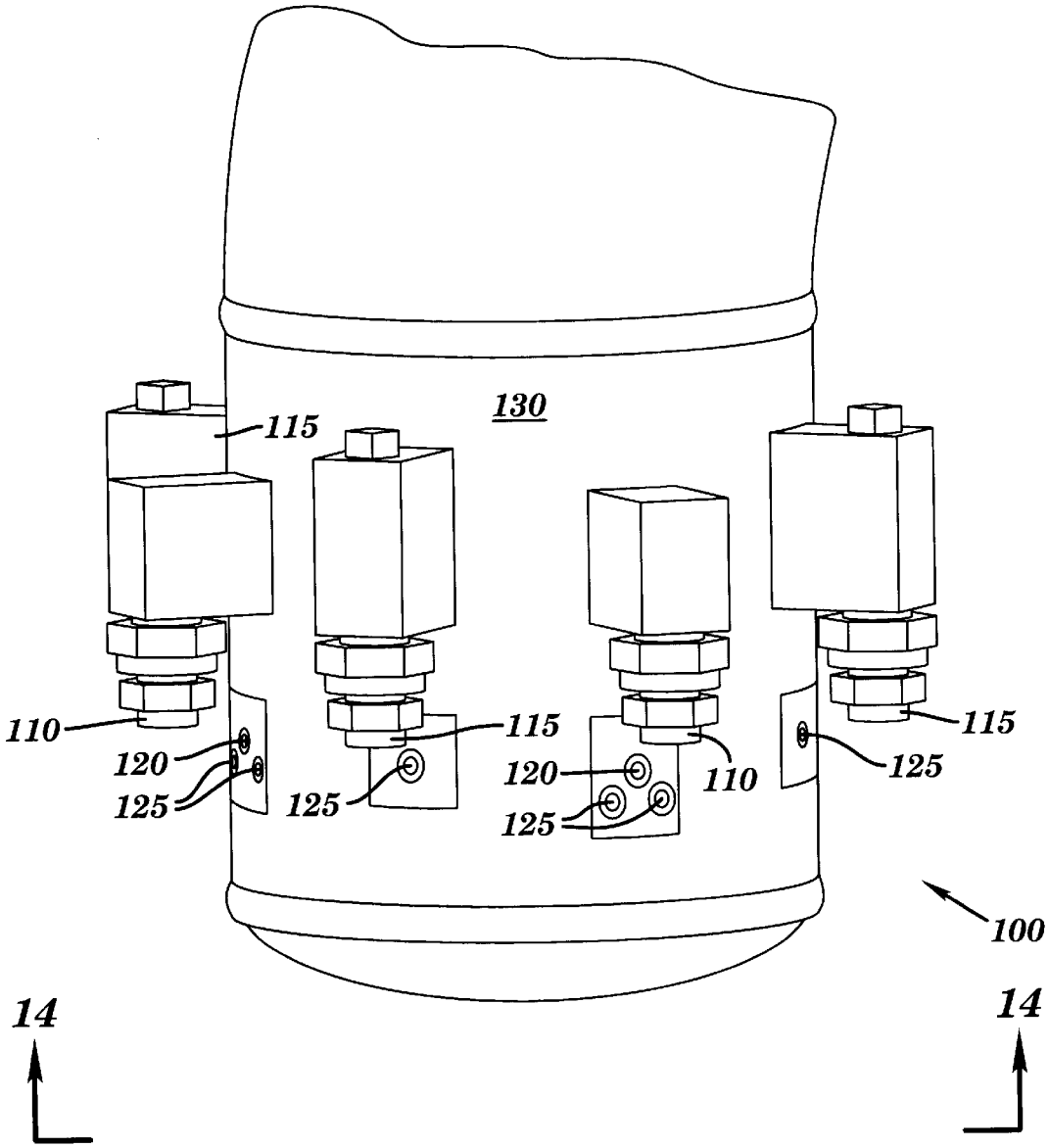
FIG. 13 is a perspective view of another embodiment of a discharge unit according to the present invention.
Figure 14:
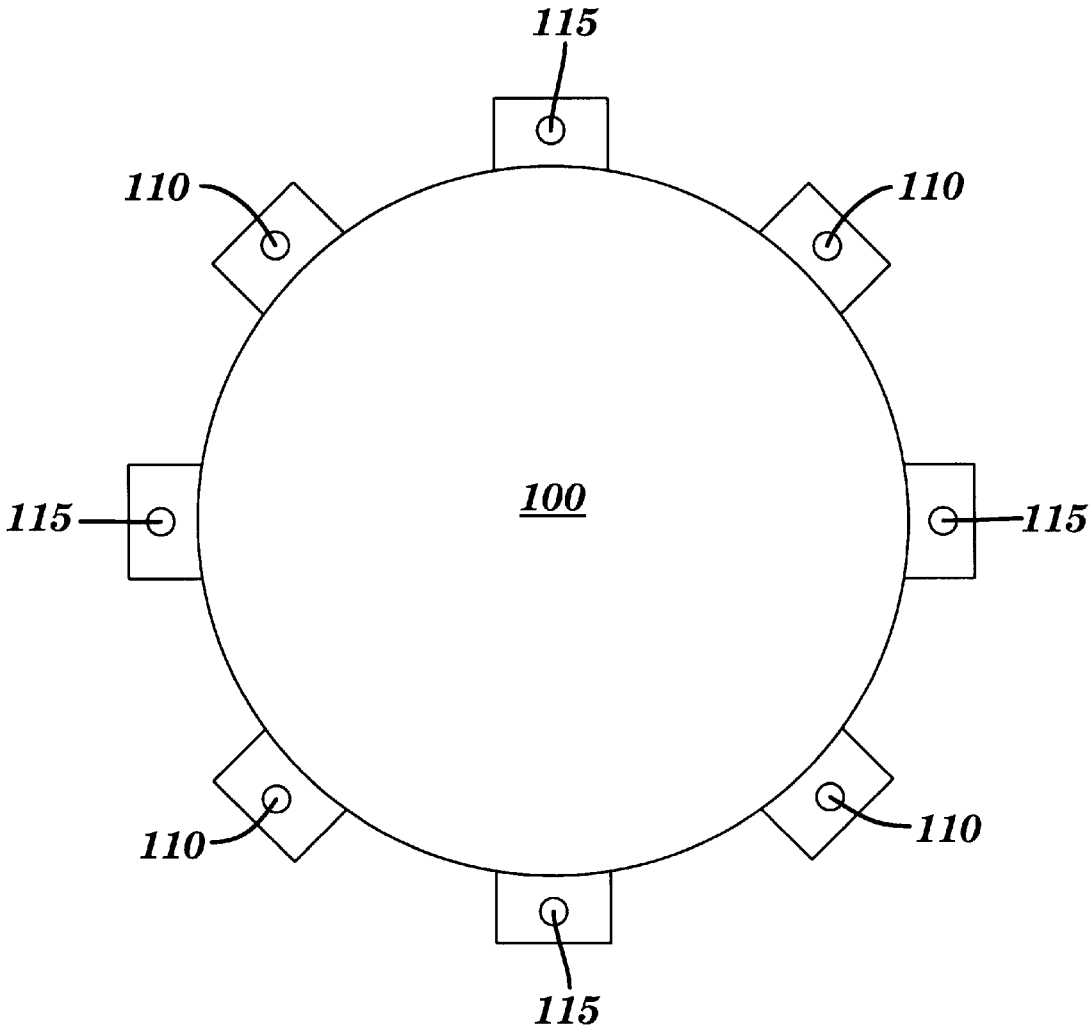
FIG. 14 is an end view of the discharge unit of FIG. 13.

FIGS. 13 and 14 illustrate a second embodiment of a discharge unit 100 according to the present invention. Discharge unit 100 may be attached to fluid flow control mechanism 18 (FIG. 1). Arranged circumferentially around discharge unit 100 are a plurality of primary water nozzles 110, a plurality of secondary water nozzles 115, a plurality of primary air discharge nozzles 120, and a plurality of secondary air discharge nozzles 125. Primary water nozzles 110 may be in constant fluid communication with a source of water and primary air discharge nozzles 120 may be in constant fluid communication with a source of air when the device is in operation, for example, in fluid communication with outer fluid conduit 21 and inner fluid conduit 19, respectively. These water and air conduits are in fluid communication with sources of water and air, respectively, preferably, pressurized sources thereof. Secondary water nozzles 115 and secondary air nozzles 125 may be connected to fluid flow control mechanism 18 which may allow one or several of these nozzles to be selected for use at a given time depending on ambient temperature conditions.

For example, discharge unit 100 may include four primary water discharge nozzles 110, four secondary water discharge nozzles 115, four primary air discharge nozzles 120, and twelve secondary air discharge nozzles 125. Several of the air and water discharge nozzles may be connected to fluid flow control mechanism 18 while several may bypass fluid flow control mechanism 18 and may be in constant communication with a source of fluid and/or air. This allows some of the nozzles to be selectable by a user depending on ambient temperature conditions while the others are beyond the user's selection and thus utilized wherever discharge unit 100 is in operation. For example, four of water discharge nozzles 110 and four of air discharge nozzles 120 may be in constant fluid connection with outer fluid conduit 21 and inner fluid conduit 19, respectively, of fluid conduit 16.

Figure 15:
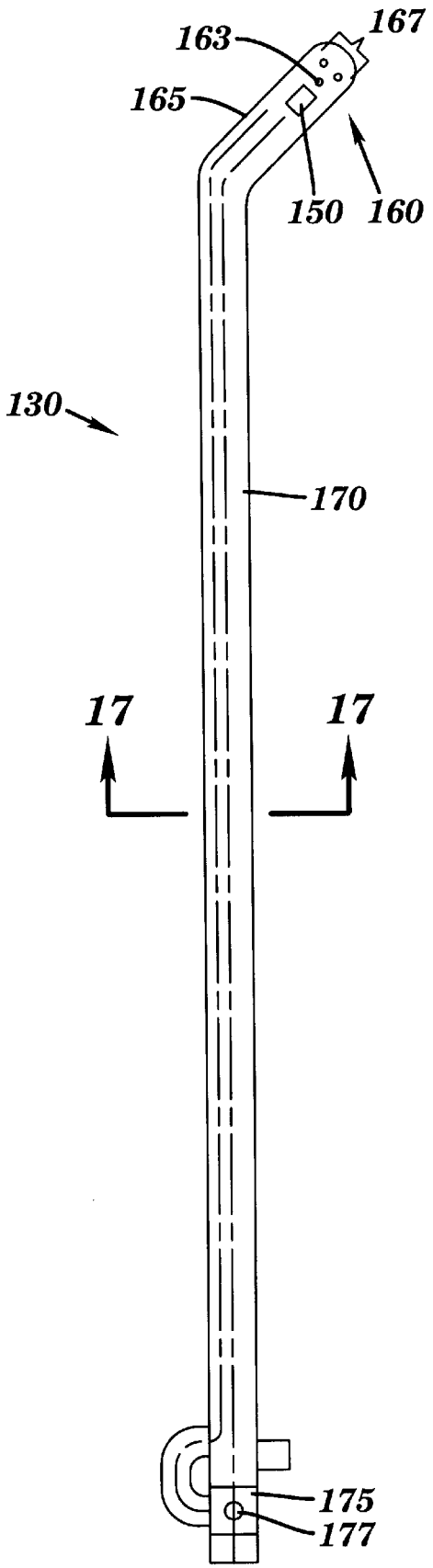
FIG. 15 is another embodiment of a snow making device according to the present invention.
Figure 17:
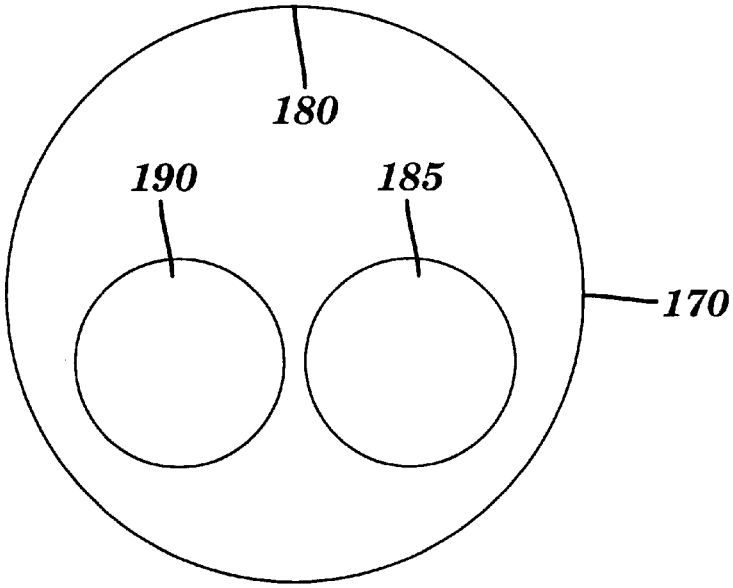
FIG. 17 is an enlarged cross-sectional view taken along line 17—17 of FIG. 15.

FIGS. 15 and 17 illustrate another embodiment of a snow making device 130 according to the present invention. The snow making device includes a discharge unit 165 connected to a fluid conduit 170 which may be connected to a regulator 175, for example, a ball valve. Fluid conduit 170 may include a water conduit 180, a primary air conduit 185, and a secondary air conduit 190, as illustrated in FIG. 17. Primary air conduit 185 and secondary air conduit 190 may be inner conduits contained by water conduit 180. Water conduit 180 may be in communication with a source of water and primary air conduit 185 and secondary air conduit 190 may be in fluid communication with a source of air. Preferably, water conduit 180 is in direct fluid communication with a pressurized source of water, while primary air conduit 185 and secondary air conduit 190 are connected to regulator 175 which is fluid communication with a source of pressurized air. Also, primary air conduit 185 and secondary air conduit 190 may be of different diameters, thus allowing regulation of air flow per unit time and air pressure by selecting therebetween.

As shown in FIG. 15, discharge unit 165 includes, for example, two water discharge nozzles 150 (only one of which is shown in FIG. 15) and six air discharge nozzles 160 (only three of which are shown in FIG. 15) distributed thereon. Water discharge nozzles 150 and may be in constant fluid communication with the source of water, when snow making device 130 is in use. Two primary air discharge nozzles 163 of air discharge nozzles 160 and four secondary air discharge nozzles 167 of air discharge nozzles 160 may be operatively connected to regulator 175, thus allowing the user to turn a handle 177 to a first position and provide fluid communication between primary air conduit 185 and primary air discharge nozzles 163. Alternatively, the user may turn handle 177 to a second position, further causing fluid communication between secondary air discharge nozzles 167 and secondary air conduit 190. Further, the user may turn handle 177 to a third position to cause fluid communication between only secondary air discharge nozzles 167 and secondary air conduit 190.

When it is desired to manufacture snow using the present invention, the water and air inlets may be connected to pressurized water and air supply conduits. Returning to FIG. 1, water and air then flow through control unit 14, fluid supply conduit 16 and into fluid flow control mechanism 18 for distribution to and discharge from discharge unit 12.

Figure 6:
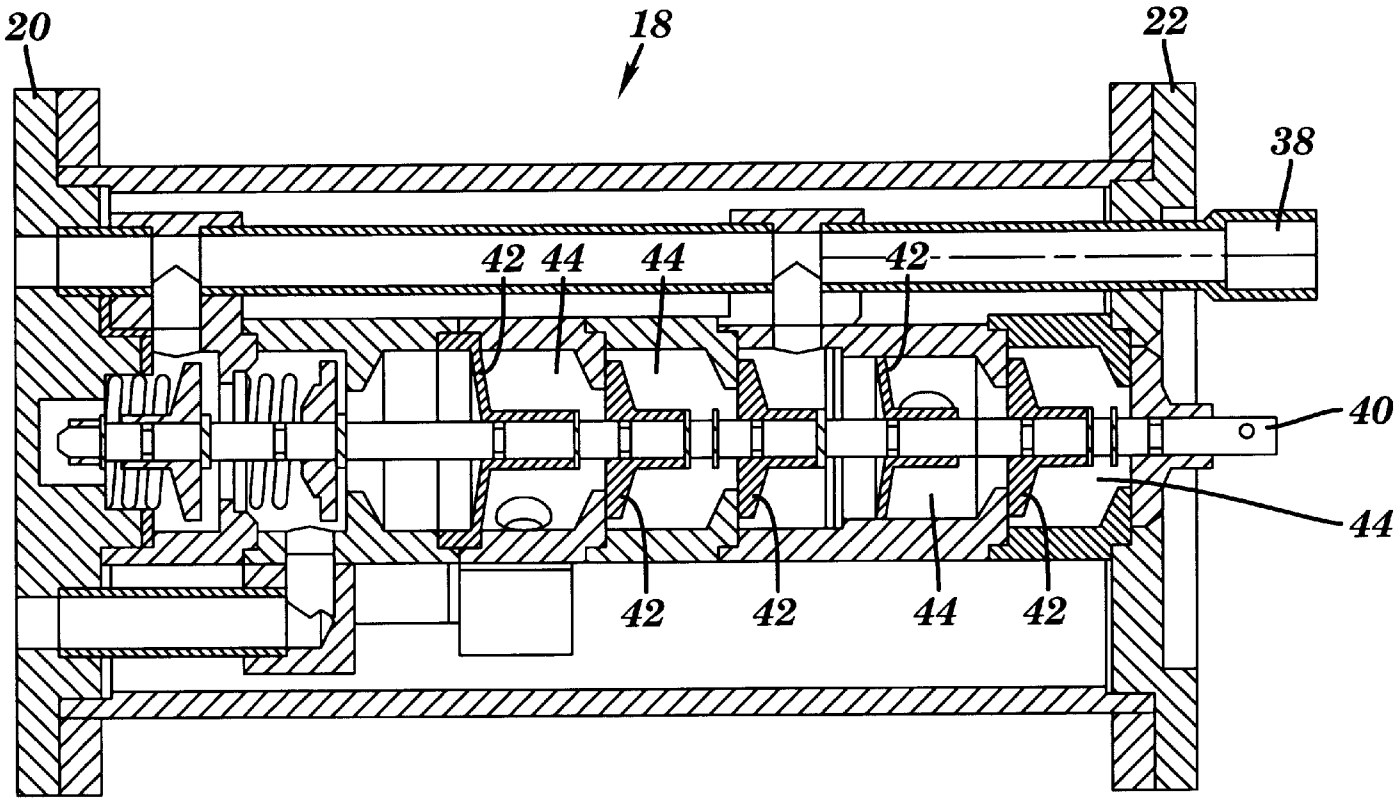
FIG. 6 is a cross-sectional view taken along line 6—6 of FIG. 5.

One example of a system and method regulating the air and water ratio is described as follows. Referring to FIG. 6 and FIG. 11, when it is desired to have a high air to water ratio, an operator may adjust handle 50 of control unit 14 to a first position which in turn moves rod 40 to a position which opens and/or closes the appropriate valves to allow water discharge from the primary water discharge nozzles 26 (FIG. 3), and air discharge from the primary air discharge nozzles 24 (FIG. 3). As can be seen in FIG. 3, there are eight primary air discharge nozzles 24 and four primary water discharge nozzles 26. This provides a high air to water ratio allowing quality snow manufacture at elevated ambient air temperatures, for example at about 28 degrees Fahrenheit.

Figure 7:
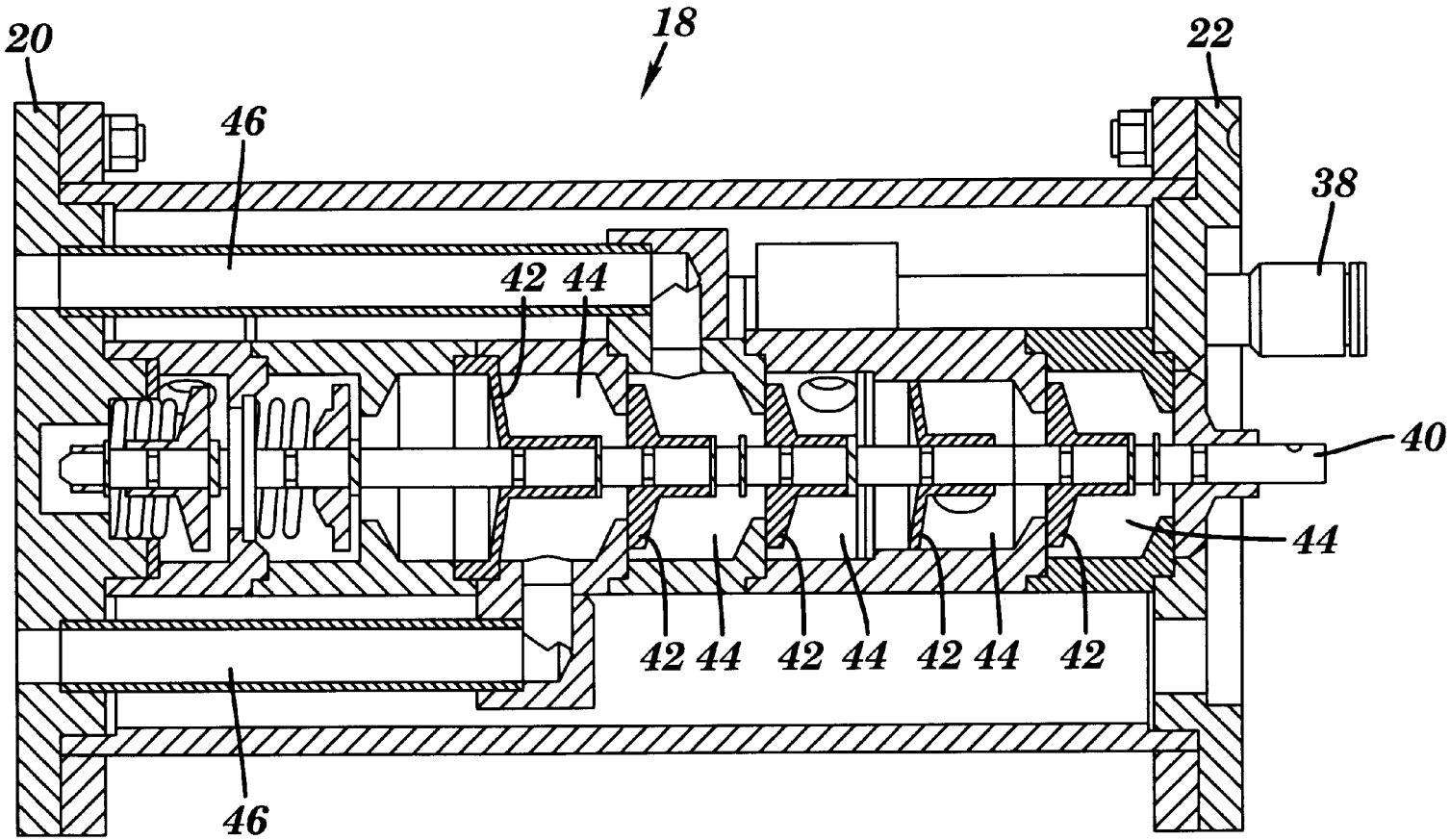
FIG. 7 is a cross-sectional view taken along line 7—7 of FIG. 5.

Referring to FIG. 7, if the ambient air temperature lowers, for example to about 25 degrees Fahrenheit, an operator may adjust handle 50 (FIG. 11) of control unit 14 (FIG. 11) to a second position, which in turn moves rod 40 to a position which opens and/or closes the appropriate valves to allow water discharge from the primary water discharge nozzles 26 (FIG. 3), and air discharge from six of the eight air discharge nozzles 24 (FIG. 3). This second position provides a reduced air to water ratio compared to the configuration shown in FIG. 6.

Figure 8:
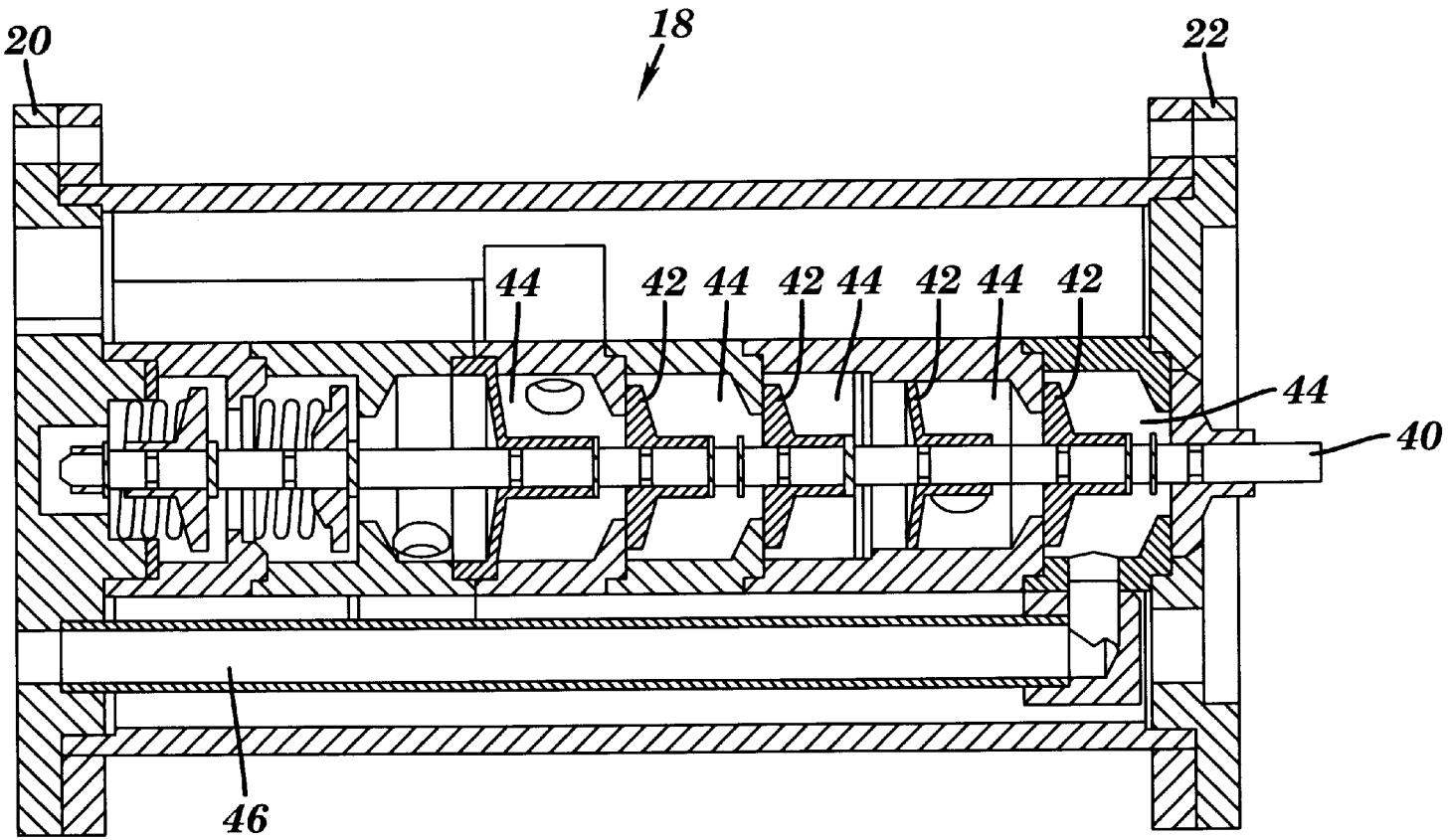
FIG. 8 is a cross-sectional view taken along line 8—8 of FIG. 5.

Referring to FIG. 8, if the ambient air temperature lowers further, for example to about 22 degrees Fahrenheit, an operator may adjust handle 50 (FIG. 11) of control unit 14 (FIG. 11) to a third position, which in turn moves rod 40 to a position which opens and/or closes the appropriate valves to allow water discharge from the primary water discharge nozzles 26 (FIG. 3), and air discharge from four of the eight air discharge nozzles 24 (FIG. 3). This third position provides a reduced air to water ratio compared to the configuration shown in FIG. 7.

Figure 9:
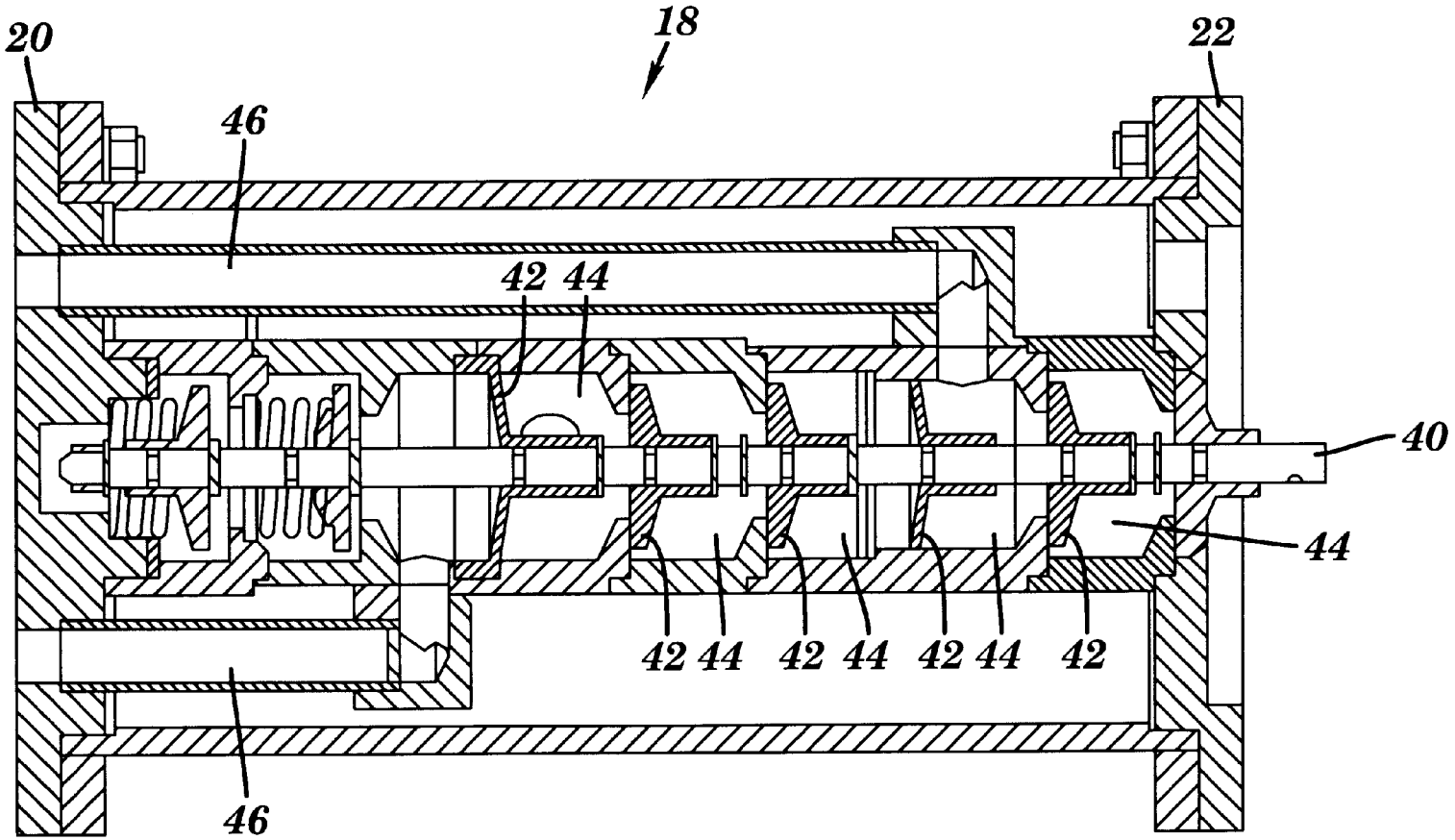
FIG. 9 is a cross-sectional view taken along line 9—9 of FIG. 5.
Figure 10:
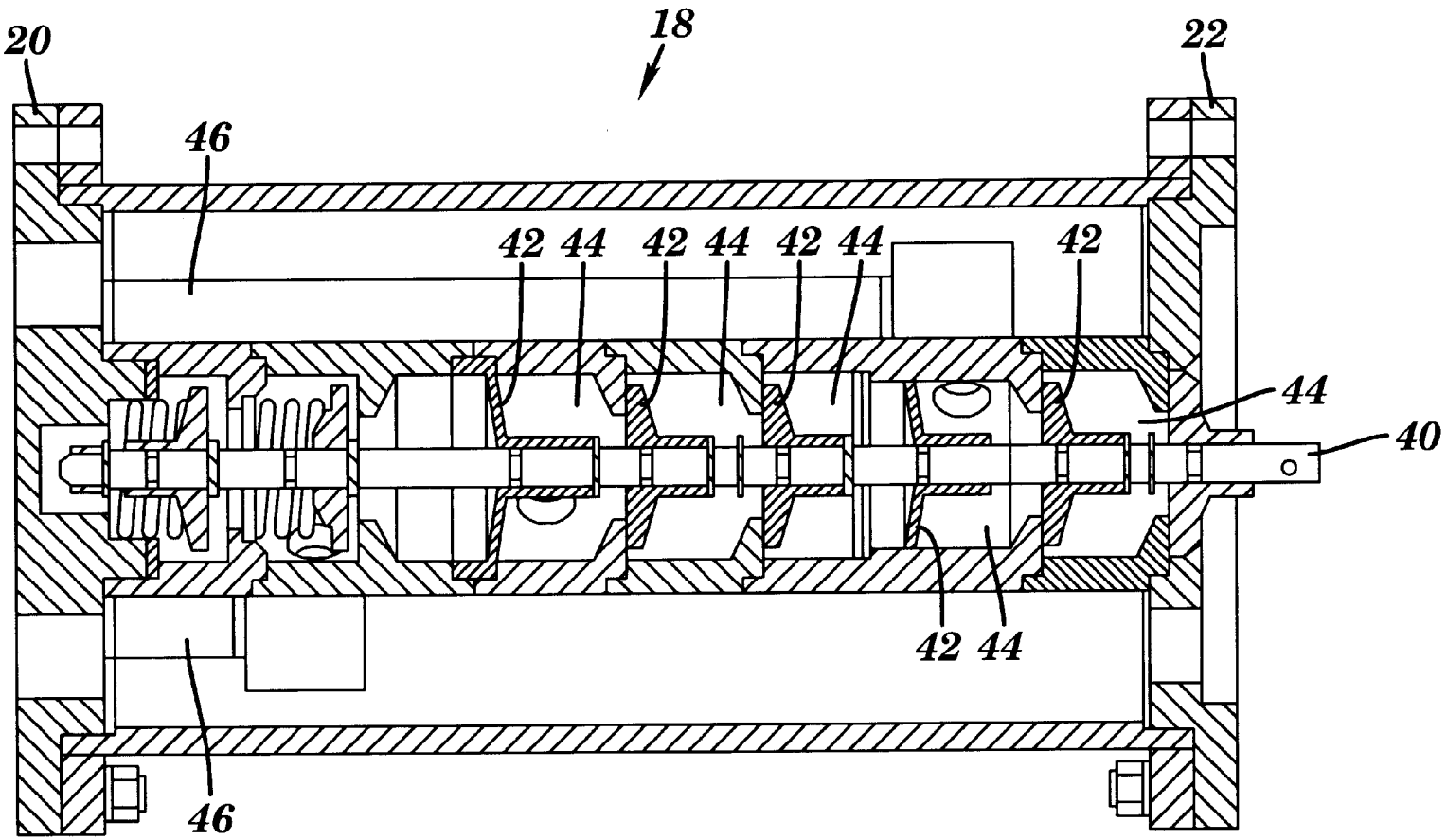
FIG. 10 is a cross-sectional view taken along line 10—10 of FIG. 5.

Referring to FIG. 9, if the ambient air temperature was to lower further, for example to an ambient temperature of about 20 degrees Fahrenheit, an operator may adjust handle 50 (FIG. 11) of control unit 14 (FIG. 11) to a fourth position, which in turn moves rod 40 to the position which opens and/or closes the appropriate valves to allow water discharge from first supplemental water discharge nozzle 30, and air discharge from first supplemental air discharge nozzle 28 as well as from the primary air and water discharge nozzles (third position). This allows an increased amount of water to be discharged, thus producing an increased amount of snow.

In optimal snow manufacturing conditions, for example at a temperature of about 18 degrees Fahrenheit, it may be desired to increase the amount of snow being produced. Therefore during such conditions, referring to FIG. 10, an operator may further adjust handle 50 (FIG. 11) of control unit 14 (FIG. 11) to a fifth position, which in turn moves rod 40 to the position which opens and/or closes the appropriate valves to allow water discharge from second supplemental water discharge nozzle 34 (FIG. 3), and air discharge from second supplemental air discharge nozzle 32 (FIG. 3) as well as from the air and water discharge nozzles of the fourth position. This allows a maximum amount of water to be discharged, thus producing a maximum amount of snow. It will be evident to those skilled in the art that optimal snow making conditions may depend on various factors including air temperature, water temperature and relative humidity.

Another example of a system and method which regulates an air and a water ratio which utilizes discharge unit 100 is described as follows. Referring to FIG. 6 and FIG. 11, when it is desired to have a high air to water ratio, for example at a temperature of about 28 degrees Fahrenheit, an operator may adjust handle 50 of control unit 14 to a first position which in turn moves rod 40 to a position which opens and/or closes the appropriate valves to allow water discharge from primary water discharge nozzles 110 (FIG. 14), and air discharge from primary air discharge nozzles 120 (FIG. 14) and secondary air discharge nozzles 125. This provides a high air to water ratio allowing quality snow manufacture at elevated ambient air temperatures. As can be seen in FIGS. 13 and 14, there are four primary air discharge nozzles 120 (only two of which are shown), twelve secondary air discharge nozzles 125 (only six of which are shown), four primary water discharge nozzles 110, and four secondary water discharge nozzles 115.

Referring to FIG. 7, if the ambient air temperature lowers, to about 22 degrees Fahrenheit for example, an operator may adjust handle 50 (FIG. 11) of control unit 14 to a second position, which in turn moves rod 40 to a position which opens and/or closes the appropriate valves to allow water discharge from primary water discharge nozzles 110 (FIG. 13), and air discharge from primary air discharge nozzles 120 and four secondary air discharge nozzles 125. This second position provides a reduced air to water ratio as compared to the configuration shown in FIG. 6.

Referring to FIG. 8, if the ambient air temperature lowers further, to about 22 degrees Fahrenheit for example, an operator may adjust handle 50 (FIG. 11) of control unit 14 (FIG. 11) to a third position, which in turn moves rod 40 to a position which opens and/or closes the appropriate valves to allow water discharge from primary water discharge nozzles 110 (FIG. 13), and air discharge from primary air discharge nozzles 120 (FIG. 13).

Referring to FIG. 9, if the ambient air temperature was to lower further, for example to a temperature of about 20 degrees Fahrenheit, an operator may adjust handle 50 (FIG. 11) of control unit 14 (FIG. 11) to a fourth position, which in turn moves rod 40 to the position which opens and/or closes the appropriate valves to allow water discharge from two secondary water discharge nozzles 115 (FIG. 13), and air discharge from two supplemental air discharge nozzles 125 (FIG. 13), as well as air and water discharge from primary air discharge nozzles 120 (FIG. 13) and primary water discharge nozzles 110 (FIG. 13), respectively.

In optimal snow manufacturing conditions, for example at a temperature of about 15 degrees Fahrenheit, it may be desired to increase the amount of snow being produced. Therefore, during such conditions, referring to FIG. 10, an operator may further adjust handle 50 (FIG. 11) of control unit 14 (FIG. 11) to a fifth position which in turn moves rod 40 to the position which opens and/or closes the appropriate valves to allow water discharge from primary water discharge nozzles 110 (FIG. 13) and four secondary water discharge nozzles 115, and air discharge from primary air discharge nozzles 120 (FIG. 3) as well as from four secondary air discharge nozzles 125. This allows a maximum amount of water to be discharged, thus producing a maximum amount of snow.

A further example of a system, illustrated in FIG. 15, and method which regulates an air to water ratio is described as follows. When snow making device 130 is in use, primary water conduit 180 (FIG. 17) is in fluid communication with a source of water and water discharge nozzles 150. Also, primary air conduit 185 (FIG. 17) may be in fluid communication with a source of air and primary air discharge nozzles 163 when handle 180 connected to regulator 175 is in a first position. In the event of a temperature rise to about 28 degrees Fahrenheit, for example, an operator may adjust the regulator from a first position to a second position by turning handle 180 to cause secondary air conduit 190 to be in fluid communication with secondary air discharge nozzles 167 and a supply of air. This allows air discharge from primary air discharge nozzles 163 and additionally from secondary air discharge nozzles 167. The operator might further adjust handle 180 to a third position to cause only secondary air conduit 190 to be in fluid communication with secondary air discharge nozzles 167.

The examples described herein are just examples. There may be many variations to the method and/or device described therein without departing from the spirit of the invention. For instance, the operational steps may be performed in a differing order, or steps may be added, deleted or modified. All of these variations are considered a part of the claimed invention.

Although preferred embodiments have been depicted and described in detail herein, it will be apparent to those skilled in the relevant art that various modifications, additions, substitutions and the like can be made without departing from the spirit of the invention and these are therefore considered to be within the scope of the invention as defined in the following claims.

What is claimed is:

1. A method for making snow, the method comprising:

providing a plurality of discharge nozzles mounted on a discharge unit; and controlling a ratio of water to air discharged from the discharge unit by selectively controlling discharge of a supply of pressurized water and a supply of pressurized air from the plurality of discharge nozzles by selecting at least one discharge nozzle from the plurality of discharge nozzles, comprising:

opening at least one first outlet of a plurality of outlets of a control mechanism;

closing at least one second outlet of the plurality of outlets; and whereby at least one of the supply of pressurized water and the supply of pressurized air is discharged through the at least one discharge nozzle of the plurality of discharge nozzles.

2. The method of claim 1, wherein the selecting the at least one nozzle comprises turning a handle of a control unit operably connected to the control mechanism among a plurality of positions to cause the discharge of water from at least one water discharge nozzle of the plurality of discharge nozzles and the discharge of air from at least one air discharge nozzle of the plurality of discharge nozzles.

* * * * *

US006547157C1

(12) INTER PARTES REEXAMINATION CERTIFICATE (1095th)

United States Patent

Jervas

(10) Number: US 6,547,157 C1

(45) Certificate Issued: Apr. 27, 2015

(54) METHOD AND DEVICE FOR MAKING SNOW

(75) Inventor: Troy Jervas, Pittsfield, MA (US)

(73) Assignee: TOPGUN SNOW MAKING SYSTEMS, INC., Hinsdale, MA (US)

Reexamination Request:
No. 95/001,961, Apr. 11, 2012

Reexamination Certificate for:

| | |
|---|---|
| Patent No.: | **6,547,157** |
| Issued: | **Apr. 15, 2003** |
| Appl. No.: | **09/754,989** |
| Filed: | **Jan. 5, 2001** |

Related U.S. Application Data

(60) Provisional application No. 60/174,753, filed on Jan. 6, 2000.

(51) Int. Cl.

| | |
|---|---|
| ***F25C 3/00*** | (2006.01) |
| ***F25C 3/04*** | (2006.01) |

(52) U.S. Cl.
CPC ..... *F25C 3/04* (2013.01); *F25C 2303/0481* (2013.01)

(58) Field of Classification Search
None
See application file for complete search history.

(56) References Cited

To view the complete listing of prior art documents cited during the proceeding for Reexamination Control Number 95/001,961, please refer to the USPTO's public Patent Application Information Retrieval (PAIR) system under the Display References tab.

*Primary Examiner* — Joseph Kaufman

(57) ABSTRACT

The present invention provides a method for making snow. The method includes discharging a supply of pressurized water in ambient air, discharging a supply of pressurized air in ambient air, and controlling the discharge of the supply of pressurized water and/or the discharge of the supply of pressurized air to regulate a ratio of water to air, to more efficiently make snow over a range of ambient temperatures.

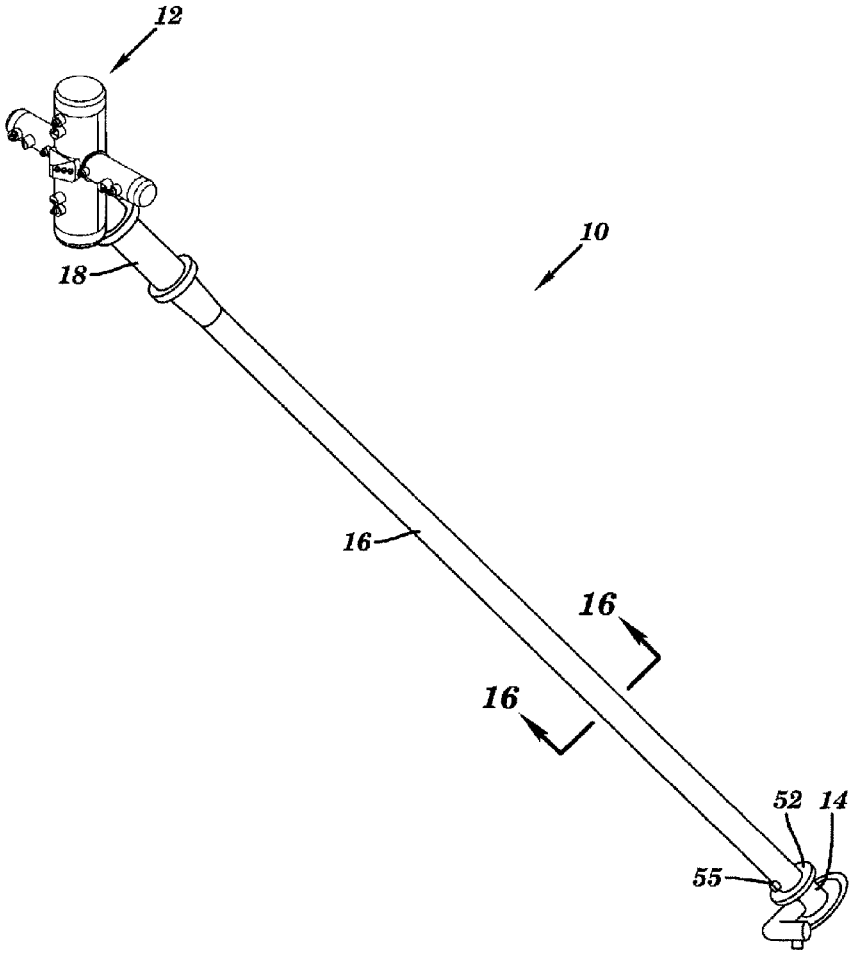

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

Claims 1 and 2 are cancelled.

* * * * *